US009914580B1

(12) United States Patent
Siciliano et al.

(10) Patent No.: US 9,914,580 B1
(45) Date of Patent: Mar. 13, 2018

(54) POCKET WAX DISPENSER

(71) Applicant: Apollo Media Group, Inc., Manlius, NY (US)

(72) Inventors: Christopher J. Siciliano, Revere, MA (US); Richard Lodge, Pittsburgh, PA (US)

(73) Assignee: Apollo Media Group, Inc., Manlius, NY (US)

( * ) Notice: Subject to any disclaimer, the term of this patent is extended or adjusted under 35 U.S.C. 154(b) by 0 days.

(21) Appl. No.: 15/262,514

(22) Filed: Sep. 12, 2016

(51) Int. Cl.

| | |
|---|---|
| ***B65D 83/00*** | (2006.01) |
| ***B65D 47/00*** | (2006.01) |
| *B05C 17/01* | (2006.01) |
| *A46B 11/00* | (2006.01) |

(52) U.S. Cl.
CPC ..... *B65D 83/0011* (2013.01); *B65D 47/00* (2013.01); *A46B 11/0027* (2013.01); *B05C 17/0133* (2013.01)

(58) Field of Classification Search
CPC . A46B 11/0027; B05C 17/0133; B65D 47/00; B65D 83/0011
See application file for complete search history.

(56) References Cited

U.S. PATENT DOCUMENTS

| | | | | | |
|---|---|---|---|---|---|
| 2,552,697 | A * | 5/1951 | Tursky | A45D 40/023 | 401/59 |
| 2,629,889 | A * | 2/1953 | Lengyel | A45D 34/042 | 132/218 |
| 3,156,387 | A * | 11/1964 | Harwood | B65D 83/0011 | 222/390 |
| 5,171,096 | A * | 12/1992 | Perrotti | A45D 40/065 | 401/59 |
| 5,979,468 | A * | 11/1999 | Blake | A45D 40/06 | 132/317 |
| 9,283,060 | B2 * | 3/2016 | Peuker | A61C 9/0026 | |
| 2014/0010928 | A1 * | 1/2014 | Orel | B65D 65/463 | 426/115 |

* cited by examiner

*Primary Examiner* — Frederick C Nicolas
*Assistant Examiner* — Bob Zadeh
(74) *Attorney, Agent, or Firm* — Bernhard P. Molldrem, Jr.

(57) ABSTRACT

A pocket wax dispenser is constructed of an elongated tubular casing with carriage of an appropriate profile to match the casing slidably fitted within the casing to travel axially within the casing without rotating, and with a piston at the distal end of the carriage. An end cap snaps or screws onto the distal end of casing. This construction results in a wax reservoir being defined in the distal part of the dispenser, i.e., within the casing and between the piston and the end cap and adapted for holding a fill of wax. The end cap has a discharge port, i.e., an opening or aperture, through which wax from within the wax reservoir can be extruded. A cutter blade may be mounted on the cap to cut the extrusion at the discharge port.

6 Claims, 3 Drawing Sheets

POCKET WAX DISPENSER

BACKGROUND OF THE INVENTION

The present invention relates a small dispenser that is designed to carry a quantity of wax and from which the user can obtain a smaller quantity of wax when desired or needed.

Waxes are employed in a wide variety of roles, including for cosmetic purposes, for medical or dental use, as edible waxes, aromatic waxes, and for furniture finish repair and polishing. Quite frequently the user needs only a small quantity of wax for a given purpose, but it has been difficult to dispense small quantities when needed without first melting or softening the wax, or to dispense the wax in a form that would be appropriate for a given use. Also, there has been a need for a pocket-size dispenser that permits the user to carry a quantity of wax in the dispenser and to squeeze out a very small quantity when needed without compromising the wax remaining in the dispenser.

SUMMARY OF THE INVENTION

It is an important object of the present invention to provide a pocket-sized wax dispenser that permits the user to obtain a small quantity of the wax when needed and retain the remaining wax so that it remains fresh and available, and which dispenser avoids drawbacks of the prior art.

It is another object to provide a dispenser that is simple to use, and which cuts the quantity of wax being dispensed at the point where it is extruded or squeezed out from the dispenser.

According to an aspect of this invention, a pocket wax dispenser is provided that extrudes a quantity of wax on demand. In a favorable embodiment, the dispenser is constructed of an elongated tubular casing with a proximal end and a distal end. A carriage of an appropriate profile to match the casing, e.g., generally cylindrical, is slidably fitted within the casing and is adapted to travel axially within the casing. A piston is affixed to the distal end of the carriage including an annular seal that bears against an inner surface of the casing. An indexer arrangement the carriage having a central axial threaded bore. An indexer arrangement prevents rotation of the carriage relative to the casing, but permits at least a limited axial travel of the carriage. An end cap snaps or screws onto the distal end of casing. This construction results in a wax reservoir being defined in the distal part of the dispenser, i.e., within the casing and between the piston and the end cap and adapted for holding a fill of wax. The end cap is made with a discharge port, i.e., an opening or aperture, through which a quantity of wax in the wax reservoir can be extruded. This provides the wax in a uniform diameter. A given quantity can be extruded as a length of the wax, measured and cut off. This construction resolves the problem of measuring waxes and concentrates. The dispenser extrudes a fairly constant calculated amount of the product per turn. The uniform extrusion allows the user to squeeze out a rather precise quantity.

Favorably, a threaded shaft is fitted within a female threaded bore formed on the axis of the carriage. A manually rotatable knob is coupled to the threaded shaft at a proximal end of the casing, including a snap ring or other suitable provision for retaining the knob within the proximal end of the casing, such that rotation of the knob rotates the shaft and advances the carriage and piston to force the desired quantity, i.e., length, of wax from the wax reservoir through the discharge port.

A cutter—e.g., a knife that is mounted on the end cap—is adapted for cutting the extruded quantity of wax at the discharge port.

The discharge port may be in the form of a round opening positioned to one side of the axis of the carriage and end cap, and may have a conic shape. The end cap may have a pivot post at a side of the axis of the carriage and cap that is opposite the position of the discharge port with the cutter then being in the form of a generally planar knife pivotally mounted upon pivot post, and with a sharp edge positioned to slice across the cap at the position of the discharge port.

In a preferred embodiment the piston may be a generally cylindrical member with a threaded member attaching it to the carriage. The piston may also have an annular recess at its distal end in which the annular seal is positioned.

The main principles invention may be explained with reference to a preferred embodiment, as illustrated in the accompanying Drawing figures.

DETAILED DESCRIPTION

Figure 1:
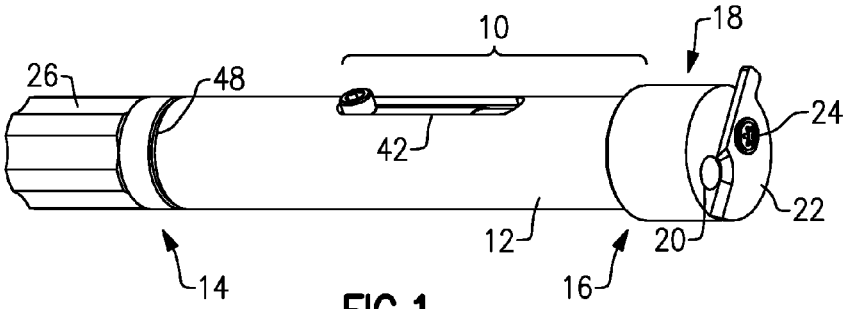
FIG. 1 is a perspective view of one preferred embodiment of the wax dispenser according to the present invention.
Figure 2:
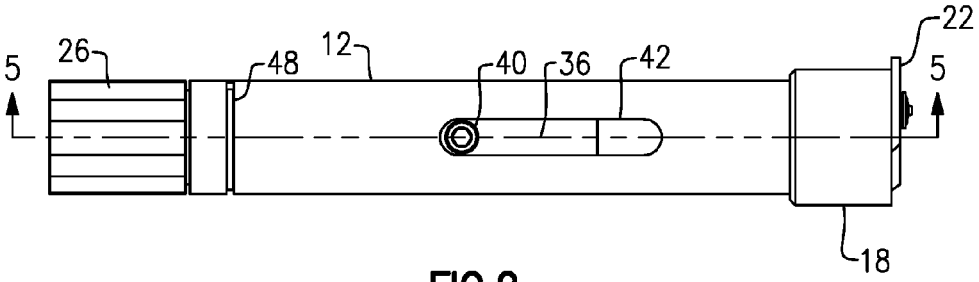
FIGS. 2, 3, and 4 are a side view, a rear or proximal end view, and a front or distal end view, respectively, of this embodiment.
Figure 5:
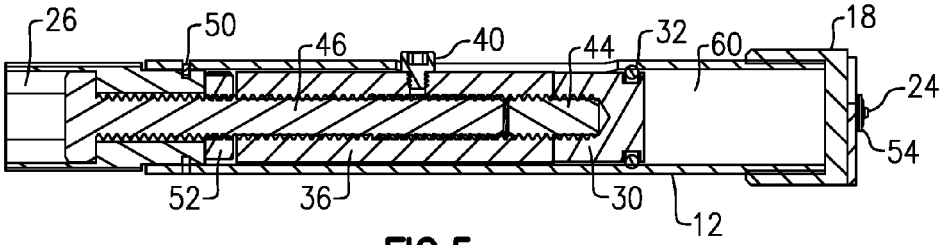
FIG. 5 is a cross-section taken at the line 5-5 of FIG. 2.
Figure 3:
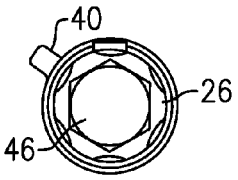

With reference to the Drawing, and initially to FIGS. 1 to 6, a wax dispenser 10 has a generally tubular casing 12 which may be formed of metal or a suitable tough plastic resin, and has a back end or proximal end 14 and a front end or distal end 16. An end cap 18 screws or snaps onto the distal end 16. The cap 18, on one side of the central axis of the dispenser has a round dispensing port 20 out from which the wax can be extruded, and which has a generally conic or frustoconic shape in this embodiment (See FIG. 5A). A cutter or generally flat metal cutting knife 22 is pivotally mounted on a pivot pin 24 that projects axially out from the end cap 18, at the opposite side of the axis, so that a cutting edge of the cutter 22 can slice the extruded quantity of wax that comes out of the dispensing port 20. The cutter also serves to cover the dispensing port 20 after the wax has been dispensed.

A knob 26 positioned at the proximal end 14 of the casing can be rotated to extrude the desired quantity of wax.

A ram or piston 30 has a profile to match the inside profile of the casing 12, with an annular seal ring 32 or O-ring seated in an annular recess 34 at the front or distal end of the piston. Here the piston 30 is cylindrical in shape. A carriage 36, here also of a cylindrical shape is configured so as to slide axially within the casing 12, and has a female-threaded open axial bore 38. A small set screw 40 is screwed into a mating opening in the side of the carriage 36, and this is configured to slide axially within an axially elongated track or cut-out 42 in the wall of the casing 12. The set screw 40 and track 42 serve to index the carriage 36 so that it can travel axially for at least a limited distance, but is restrained from rotation relative to the casing 12.

A threaded stud 44 mates the piston or ram 30 to the distal end of the carriage 36, fitting into the threaded bore of the carriage and also into a threaded aperture in the piston or ram 30.

A hex-head bolt 46 has a shaft with threads that match the threads within the bore 38 of the carriage, with the head of the bolt being seated in mating hexagonal structure in the knob 26. Also shown here are an annular or arcuate cut 48 at or near the proximal end 14 of the casing 12, and an annular ridge 50 on the knob 26 for retaining the knob in place in the casing. A washer or ring 52 fits over the shaft of the bolt 46 and between the distal end of the knob 26 and the proximal end of the carriage 36. With this construction, rotation of the knob 26 results in a distal advancement axially of the carriage and piston, and rotation in an opposite direction results in withdrawal proximally of the carriage and. piston within the casing.

Figure 4:
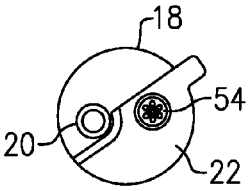
Figures 5A, 6:
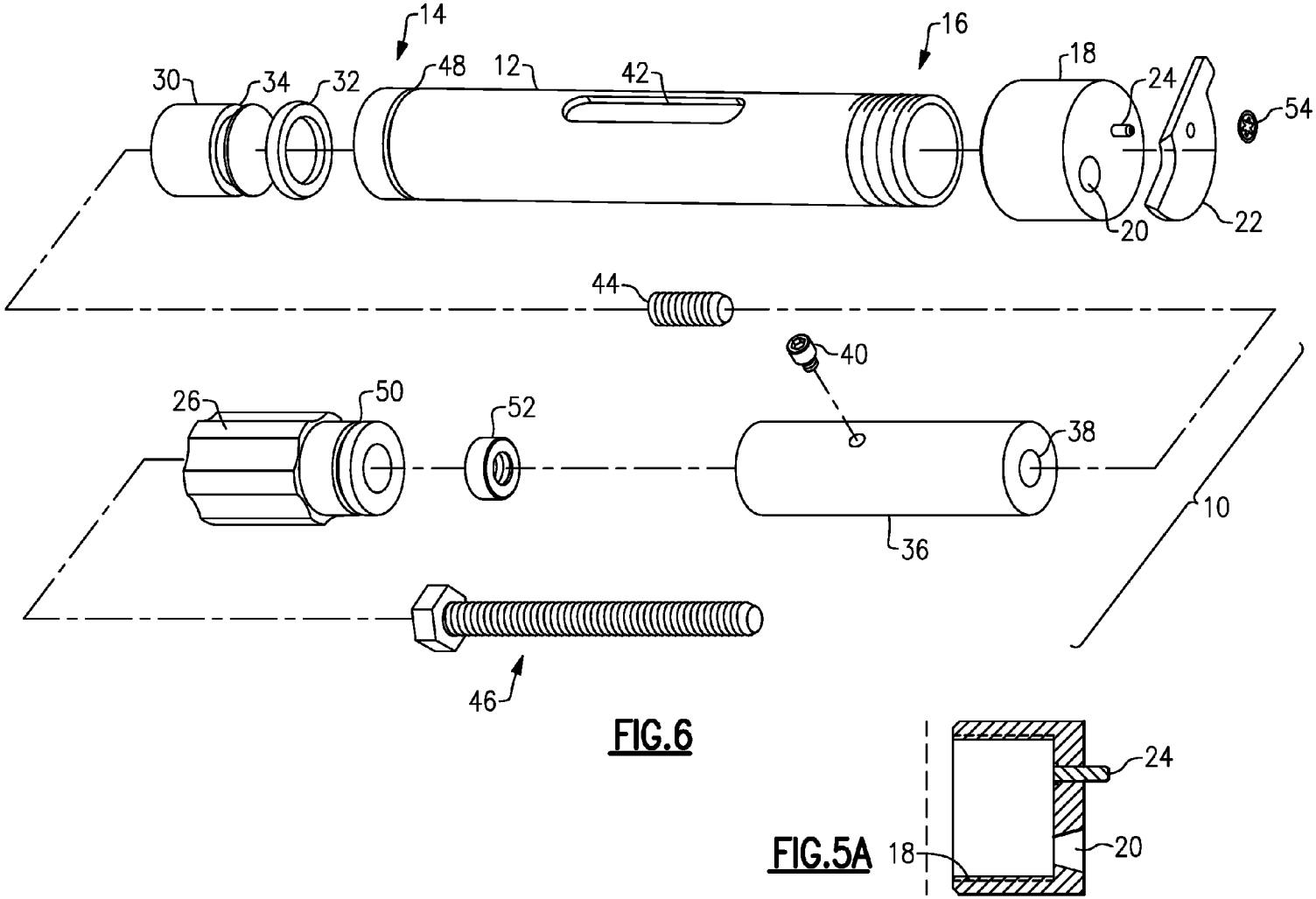
FIG. 5A is a cross-section of the end cap of this embodiment.
FIG. 6 is an exploded assembly view thereof.

As shown in FIG. 4, a push nut 54 or equivalent retainer member holds the cutter 22 onto the pivot pin 24.

A wax chamber or reservoir 60 is defined within the distal end of the chamber between the piston 30 and end cap 18, and is intended to hold a fill of the wax when the carriage 36 and piston 30 are drawn back. When the knob 26 is turned to advance the piston, some of this wax is extruded out from this reservoir 60 through the dispensing port 20 length of wax with a uniform round section, and when a sufficient quantity has been extruded, this can be cut by swinging the cutter 22 across the dispensing port.

Figure 7:
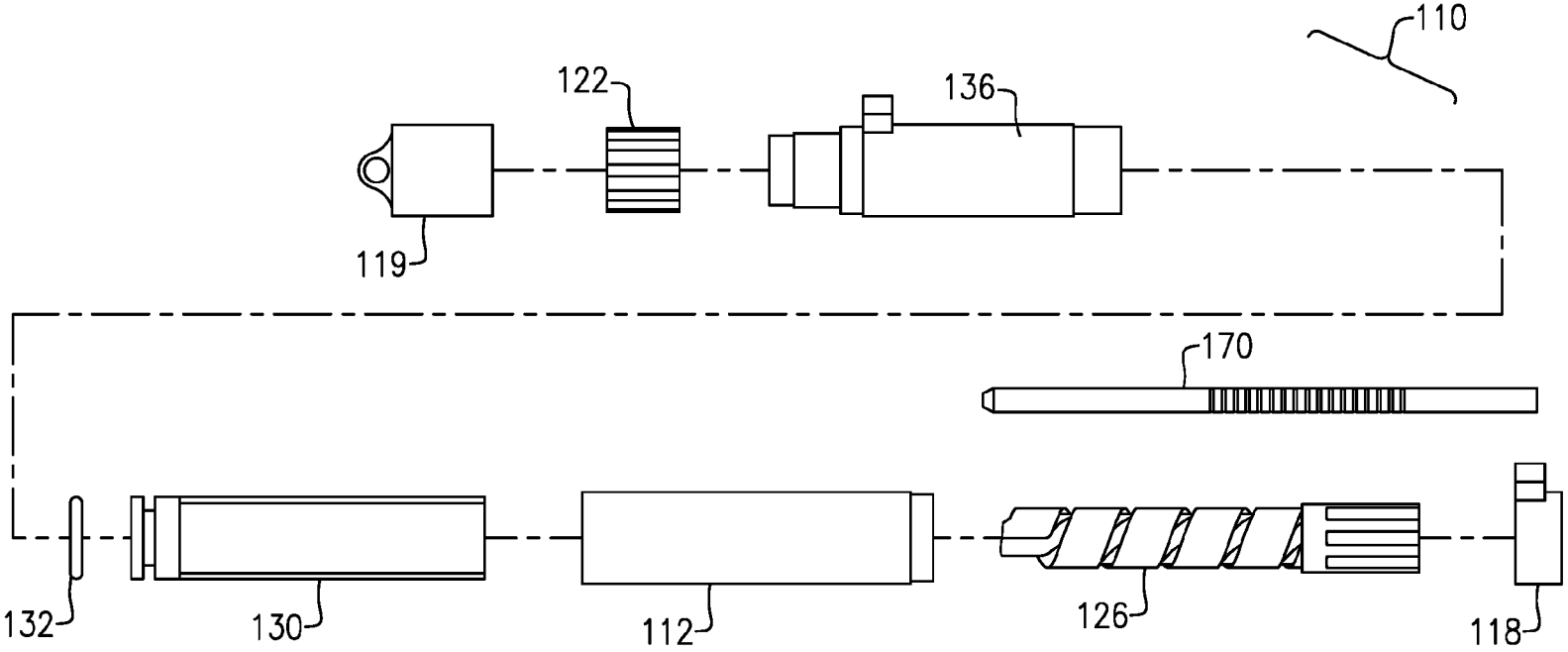
FIG. 7 is an exploded assembly view of another possible embodiment.

An alternative embodiment of the wax dispenser 110 is illustrated in an exploded assembly view of FIG. 7, where its elements corresponding elements of the first-described embodiment are identified with similar reference numbers, but here raised by 100. A tubular casing 112 is shown with a combination knob and spiral grooved shaft 126 fits into the proximal end of the casing 112. A piston or ram 130, which has an internal bore to mate with the spiral grooved shaft of the knob 126, slides fore and aft, i.e., proximally-distally with rotation of the knob, and guide ridges on the piston 130 keep the piston from rotating. As with the first embodiment, an O-ring seal 132 is positioned at the distal end of the piston. A wax holder 136 here is in the form of a hollow tubular member that the piston 130 can fit within. The cutter 122 is in the form of a rotatable cap at the distal end of the wax holder 136, and which the user can turn to cut off the quantity of extruded wax. Additional end caps or covers 118 and 119 are provided to fit over the front and rear ends of the wax dispenser 110. Also, a wand 170 for applying the dispensed quantity of wax, can be held on the wax dispenser by fitting into loop structures (not numbered) on the wax dispenser.

The wax dispenser of this invention provides a convenient way for the user to carry a quantity of the wax in a safe, contained manner, and to dispense smaller quantities of the wax when needed or desired, and without compromising the rest of the wax remaining in the wax reservoir.

In other possible embodiments, the casing, carriage and piston may have an oval, octagonal, or other non-circular profile, and the term "generally cylindrical" as applied to elements of the invention should be interpreted accordingly.

While the invention has been described in terms of selected preferred embodiments, it should be appreciated that many variations thereof are possible and would present themselves to persons of skill in the art without departing from the scope and spirit of this invention.

We claim:

1. A pocket wax dispenser for extruding a quantity of wax on demand, comprising:

an elongated tubular casing having a proximal end and a distal end;

a generally cylindrical carriage slidably fitted within the casing and adapted to travel axially within the casing, the carriage having a central axial threaded bore;

an indexer arranged to prevent rotation of the carriage relative to the casing, but permit at least a limited axial travel of said carriage;

a piston affixed to a distal end of the carriage including an annular seal that bears against an inner surface of said casing;

an end cap removably fitted onto the distal end of said casing;

a wax reservoir being defined within said casing between said piston and said end cap and adapted for holding a fill of wax;

said end cap including a discharge port through which a quantity of the wax of the fill wax in said wax reservoir can be extruded;

a threaded shaft fitted within the bore of said carriage;

a manually rotatable knob coupled to the threaded shaft at the proximal end of said casing, including means retaining the knob within the proximal end of the casing, such that rotation of the knob rotates the shaft and advances said carriage and said piston to force said quantity of wax from said wax reservoir through said discharge port; and a cutter mounted on said end cap and adapted for cutting the extruded quantity of wax at said discharge port.

2. The pocket wax dispenser of claim 1 wherein said carriage and said end cap define an axis, wherein said discharge port is a round opening positioned to one side of the axis of the carriage and end cap.

3. The pocket wax dispenser of claim 2 wherein said discharge port has a conic shape.

4. The pocket wax dispenser of claim 2 wherein said end cap is formed with a pivot post at a side of the axis of the carriage and cap that is opposite the position of the discharge port, and said cutter includes a knife pivotally mounted upon said pivot post.

5. The pocket wax dispenser of claim 4 wherein said knife has a cutting edge disposed to slice said quantity of wax at said discharge port when the knife is rotated about said pivot post.

6. The pocket wax dispenser of claim 1 wherein said piston includes a generally cylindrical member threadably attached to said carriage and having an annular recess at a distal end thereof and adapted for holding said annular seal.

* * * * *